US007183231B2

(12) United States Patent
Hoying et al.

(10) Patent No.: US 7,183,231 B2
(45) Date of Patent: Feb. 27, 2007

(54) TEXTURED MATERIALS AND METHOD OF MANUFACTURING TEXTURED MATERIALS

(75) Inventors: Jody Lynn Hoying, Maineville, OH (US); John Joseph Curro, Cincinnati, OH (US); Susan Nicole Lloyd, Erlanger, KY (US); John Brian Strube, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 135 days.

(21) Appl. No.: 10/289,770

(22) Filed: Nov. 7, 2002

(65) Prior Publication Data

US 2003/0087571 A1 May 8, 2003

Related U.S. Application Data

(60) Provisional application No. 60/349,486, filed on Nov. 7, 2001.

(51) Int. Cl.

| | |
|---|---|
| ***D03D 15/00*** | (2006.01) |
| ***D03D 25/00*** | (2006.01) |
| ***D03D 11/00*** | (2006.01) |
| ***D04B 1/00*** | (2006.01) |

(52) U.S. Cl. ..... 442/181; 442/304; 28/160

(58) Field of Classification Search ..... 442/408, 442/181, 304

See application file for complete search history.

(56) References Cited

U.S. PATENT DOCUMENTS

| | | | | |
|---|---|---|---|---|
| 1,059,200 | A | | 4/1913 | Parkinson et al. |
| 2,252,123 | A | | 8/1941 | Gross |
| 2,424,124 | A | | 7/1947 | Seemuller |
| 3,641,635 | A | | 2/1972 | Martin |
| 3,714,687 | A | | 2/1973 | van Tilburg |
| 3,803,672 | A | * | 4/1974 | McGuffin et al. ..... 26/74 |
| 3,810,280 | A | * | 5/1974 | Walton et al. ..... 26/18.6 |
| 4,000,342 | A | | 12/1976 | Rochelle et al. |
| 4,223,063 | A | * | 9/1980 | Sabee ..... 442/400 |
| 4,323,068 | A | | 4/1982 | Aziz |
| 4,364,156 | A | | 12/1982 | Greenway et al. |
| 4,393,562 | A | | 7/1983 | Stokes |
| 4,471,514 | A | | 9/1984 | Stokes |
| 4,499,637 | A | | 2/1985 | Greenway |
| 4,810,558 | A | | 3/1989 | Hornung et al. |

(Continued)

FOREIGN PATENT DOCUMENTS

| | | |
|---|---|---|
| EP | 0 007 221 | 1/1980 |

(Continued)

*Primary Examiner*—Norca L. Torres-Velazquez
(74) *Attorney, Agent, or Firm*—Jay A. Krebs; Angela Marie Stone; Leonard W. Lewis

(57) ABSTRACT

The present invention is directed to a textile material comprising yarns wherein the material is textured by subjecting specified regions of the material to incremental strains sufficient to cause yarn failures or yarn elongation in yarns running in one direction within the specified regions. The yarns in a direction orthogonal to the direction of the failed or elongated yarns will generally have substantially unaltered physical properties and are redistributed within the specified regions. Typically, the yarn failures or elongation will be in the fill direction and yarns in the warp direction will have unaltered physical properties and be redistributed within the specified regions. Also included in the present invention is a method of manufacturing the textured textile material.

12 Claims, 9 Drawing Sheets

U.S. PATENT DOCUMENTS

| | | | | | |
|---|---|---|---|---|---|
| 4,951,366 | A | | 8/1990 | Geller | |
| 4,953,270 | A | | 9/1990 | Gilpatrick | |
| 5,035,031 | A | | 7/1991 | Elliott | |
| 5,080,952 | A | * | 1/1992 | Willbanks | 428/91 |
| 5,148,583 | A | | 9/1992 | Greenway | |
| 5,400,485 | A | | 3/1995 | Bialostozky-Krichevsky | |
| 5,404,626 | A | | 4/1995 | Bylund et al. | |
| 5,425,162 | A | | 6/1995 | Buis et al. | |
| 5,616,405 | A | * | 4/1997 | Kishi et al. | 442/60 |
| 5,628,097 | A | * | 5/1997 | Benson et al. | 28/165 |
| 5,647,937 | A | | 7/1997 | Ronai | |
| 5,752,300 | A | | 5/1998 | Dischler | |
| 6,195,854 | B1 | | 3/2001 | Catallo | |

FOREIGN PATENT DOCUMENTS

| | | |
|---|---|---|
| EP | 0 057 999 | 8/1982 |
| EP | 0 059 029 | 9/1982 |
| EP | 0 099 639 | 2/1984 |
| EP | 0 120 709 | 10/1984 |
| EP | 0 351 065 B1 | 6/1994 |

* cited by examiner

TEXTURED MATERIALS AND METHOD OF MANUFACTURING TEXTURED MATERIALS

CROSS REFERENCE TO RELATED APPLICATIONS

This application claims the benefit of U.S. Provisional Application No. 60/349,486, filed Nov. 7, 2001.

FIELD OF THE INVENTION

The present invention is directed to textile materials having a texture created by a post-processing technique. It also relates to the methods for modifying the textile materials.

BACKGROUND

Many types of treatments or modification of fabrics have been developed. Fabrics at various times during manufacture have been treated to alter existing characteristics to obtain a fabric that is desired by the consumer. Known practices include modifying fabrics by laundering, beating, chemical treatment, shearing fibers, embossing, selective heating, selective dyeing or bleaching, thermal calendaring, abrading, and treating with jets of hot fluids or air, among others. Different methods, such as shearing fibers, treating with hot fluid jets or using heated drums or patterned rolls are employed to create textured or sculptured effects. By use of these techniques, yarns in the fabrics are selectively cut, crushed, melted, or softened so that a patterned or sculptured effect is formed in the treated location.

Cutting or shearing methods are commonly used in the textile industry to create tuffs of material. The shearing action typically occurs by a blade or sharp implement. This is a very precise method and requires specific equipment to ensure that the yarns are not cut too severely or that more yarns than intended are not cut. When cutting occurs, all yarns in a weave in the area where the material contacts the blade will be cut. Additionally, the blades will need to be frequently sharpened depending upon the fabric used.

Other methods used to create texture in a textile material include the use of heat and/or chemicals. One example of this is embossing. Embossing occurs through a heated calendaring process where the fabric is engraved in specified areas to cause Z plane deformation without substantial movement or displacement of yarns in the X and/or Y direction. Embossing is a macro displacement process that generally involves multiple yarns in each engraved area.

The lack of X and/or Y direction displacement can be seen by examining an embossed material with an optical microscope using only back light. Removal of reflective light will eliminate the visual affects caused by shadowing and will bring emphasis to the weave pattern. In embossed fabrics, the weave spacing remains the same in both embossed and unembossed areas.

Texturizing of fabrics or textiles can be achieved during initial formation of fabrics by knitting, weaving, flocking or tufting techniques. The desired texture or pattern can also be achieved through finishing process. With a finishing process, the same starting fabric can be used to create many different textured fabrics. This allows for easily changing a pattern to meet changing consumer needs without excessive inventory.

Therefore, it is an object of the present invention to provide a textile material that has been textured through a finishing process. It is also an object of the invention to provide an economical and efficient process to achieve the texturing of a textile material.

SUMMARY

The present invention is directed to a textile material comprising yarns wherein the material is textured by subjecting specified regions of the material to incremental strains sufficient to cause yarn failures or yarn elongation in yarns running in one direction within the specified regions. The yarns in a direction orthogonal to the direction of the failed or elongated yarns will generally have substantially unaltered physical properties and are often redistributed within the specified regions. Typically, the yarn failures or elongation will be in the fill direction and yarns in the warp direction will have unaltered physical properties and be redistributed within the specified regions.

Also included in the present invention is a method of manufacturing the textured textile material. The method comprises the steps of providing a base textile material, providing an incremental stretching means, and subjecting the base textile material to incremental strains by the incremental stretching means causing a strain sufficient to cause yarn failure or permanent elongation in specified regions of the textile material.

BRIEF DESCRIPTION OF THE DRAWINGS

FIG. 2 is an optical microscope image of a material.

DETAILED DESCRIPTION

Textile

Figure 1:
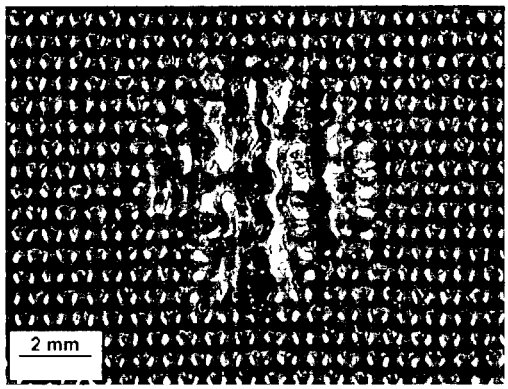
FIG. 1 is an optical microscope image of a specified region of a textile material that has been subjected to a sufficient strain to induce yarn tearing.

The present invention relates to textile materials. Textile is defined as a woven or knit fabric. The textile material may consist of cotton, polyester, acetate, wool, silk, rayon, nylon, lycra, polypropylene, polyethylene, and combinations thereof. It is preferred that the fiber elasticity of the material is not high enough to recover from the entire strain. The material may be an undyed natural color or may be dyed prior to processing. The material may also be printed with a particular design or pattern before the texturizing. Yarns in the textile material may be yarns of natural or synthetic fiber or blends thereof. Stitch bonded nonwovens and Neotis™ fabrics (elastically recoverable or non-elastic) available from DuPont are all suitable textile materials. Composites of textiles, nonwovens, films, felts, foams, foils, leather, batting, scrim, and combinations thereof may all be used.

The textile material may be a weave. Materials of tight woven construction and high thread count are preferred. The textile material will have a plurality of yarns preferably oriented in a first direction and a plurality of yarns oriented in a second direction preferably perpendicular to the said first yarn direction. The textile may be of plain, twill, or satin weave, or any variation thereof.

When the textile material is a knit it is preferred that the knit chosen be of a controlled construction designed to minimize the elasticity of the fabric. If the knit's loop structure allows for large amounts of elastic recovery it will be difficult to create durable deformation through applied strain.

Yarns

The textile material will contain many yarns. The yarns may also be referred to as threads. In the woven textile material, the yarns will form a weave. Yarns that run lengthwise in a bolt of material are said to run in the warp direction. During processing, this direction is typically referred to as the MD, machine direction. The yarns which run orthogonal or perpendicular to the warp direction are said to run in the weft direction. These yarns are also called fill yarns, or wales. This direction is typically the CD, cross direction, during processing. The textile material can have different yarns in the weft and warp direction. Additionally, yarns in the weft or warp direction may each comprise different materials and have different properties. For example, the yarns may have different yarn denier, elongation, material compositions, colors, reflective properties, and other differences found in fabrics. A yarn itself may be comprised of different material compositions. A weave having different colors in the warp and weft directions may result in a marble effect after the textile material is processed. This aesthetic effect is created by a new color distribution formed when the weft yarns are torn and/or pushed through the warp yarns. The texturizing process may also alter the reflection of reflective yarns and or fibers contained in textile materials.

Texture

The textile material of the present invention is textured. Textured may also be described as patterned or marked. Textured means the material is purposely altered in the X and/or Y direction to create Z direction deformation. Three dimensional texturing or patterning occurs by redistributing, elongating, or tearing selected yarns of the textile material. The texture or pattern developed may be any size, shape, or density. Specified regions of the material within the pattern will have different texture than other regions of the material. The texture may create a tufted appearance where yarns are displaced or torn. The texture may create a different color effect. The selection of pattern is unlimited and may be stripes, checks, diamonds, or isolated pattern areas of any shape. Preferably, the density, size, shape, or type of the protrusions creating the pattern are limited to allow for a finite number of continuous yarns to extend in both the warp and weft directions of the fabric. This will ensure fabric failure does not occur. For patterns with a high density of protrusions, a fabric with tight weave spacing may be desired. This will enable enough yarn intersections to remain to lock or hold torn yarns and maintain fabric strength and stability. If all yarns in one direction across the width of the fabric are destroyed at some location, the fabric may still remain in tact if a large number of yarn intersections between textured areas remain. Alternatively, a nonwoven, film, or separate woven article may be bonded to the back of a textured fabric prior to or after texturing to ensure that sufficient strength and stability is maintained.

Incremental Strains

The yarns in the textile material will be subjected to incremental strains. The incremental strains or elongation will be applied to a specified region of the material. Certain yarns in the specified regions will be physically altered. A sufficient strain will be applied so that the yarns in one direction will be strained until yarn failure or elongation of the yarn occurs. The amount of strain necessary to cause yarn failure or elongation will depend upon many properties including the material composition, weave type, yarn count, depth of engagement of teeth, footprint of deformation, and processing speed. Generally, the yarn failures or elongation will only occur in yarns running in one direction. Failures or elongation of yarns in only one direction means that yarns in one direction are substantially torn, elongated to failure, or permanently elongated within specified areas.

Yarn failure can mean tearing or breaking under applied strain. When a yarn tears, the friction lock on that yarn is lost and the yarn is free to retract into the remaining matrix. Yarn failure does not include cutting, shearing, or severing of the yarns due to a sharp blade-like implement. Elongation of yarns occurs when the yarn is strained to a point that is does not return to its previous length without the application of heat or other treatment to reverse polymeric deformation.

Unaltered, Displaced Yarns

Yarns orthogonal or perpendicular to the direction in which the yarn failures or permanent elongation of yarns occurs remain substantially physically unaltered. Substantially unaltered physical properties of the yarns means that the yarns will have the same mechanical strength and elongation to break and substantially the same number of fibers per yarn. Although small amounts of fibers within the physically unaltered yarns may be torn or strained to failure, the yarn itself remains substantially intact. However, in limited cases, a small number of these yarns may be torn or elongated as long as the appearance, strength, and usefulness of the textile material is not substantially changed.

The yarns in the orthogonal direction to the yarn failures or permanent elongation will typically be redistributed. Redistributed means that the yarn is bunched, gathered, or moved to a new location due to the yarn sliding over obtrusions. The yarns will typically have substantially unaltered physical properties and be redistributed. Without the restraining force of the now torn yarns, the remaining elements of the orthogonal yarns may spread into a relaxed state that appears crimped due to deformation caused by being held in the weave.

For example, when a strain is applied in a specified region, the yarns in the weft direction may tear or elongate. The yarns in the warp direction will remain substantially physically unaltered but will likely be redistributed.

The texture created on the material may be permanent or durable. This depends on the material, pattern created, and treatment of the fabric. For example, the texture is not removed by normal use and laundering, but a hot iron or high tensile forces can reduce or eliminate the texture. Torn yarns will create a permanent texture.

Process

The present invention also relates to the process for the addition of texture or patterning to textile materials. The invention involves trapping a textile material between two engaging patterned rolls that are driven in a rotating motion. The rolls have corresponding teeth and groves that create an incremental unidirectional strain upon any material that passes between the two teeth. When the composition or construction of the material prevents these localized areas from extending to meet this strain, discrete failure results. Each failure is marked by discrete yarn tears that permanently mark or texture the fabric. Yarn tears and elongation are mostly limited to the direction perpendicular to the tooth. Yarns parallel with each tooth are either friction locked onto the tooth or pushed off of the side of the tooth creating a slight redistribution of the yarns.

Tooth radius or thickness can be similar in size to the yarn thickness. Depth of engagement is typically from about 0.020 to 0.250 inches and preferably from about 0.050 to about 0.090 inches. The pitch, distance between teeth, is typically from about 0.040 to about 0.300 inches and preferably from about 0.60 to about 0.200 inches. One having ordinary skill in the art will need to select the appropriate range of depth of engagement for a specific pitch to produce the desired result. Material characteristics must also be considered in the selection.

When a yarn is torn, the friction lock over the tooth is lost and the yarn may be drawn in the neighboring matrix by local strains caused by additional protruding teeth. It is believed that when deformation in the X and Y direction occurs, yarn redistribution that occurs on or directly beside the engaging tooth depends on the location of the closest warp yarn to the tooth. When the warp yarn is friction locked onto the tooth, the deformation occurs directly beside the tooth. When the tooth hits a space directly between two warp yarns, the redistribution occurs directly on the tooth.

The resulting textured textile material appearance is attributed to the composition of the material, the yarn spacing and relative angle between the warp and fill yarns. The relative spacing, number, and size of the protruding teeth or pattern, along with the depth of the protrusion and speed of the rotating rolls are also influential to the final appearance of the material.

This process does not require chemical treatment or heat. It is understood though that such treatment could aid the process and final material characteristics.

Figure 8:
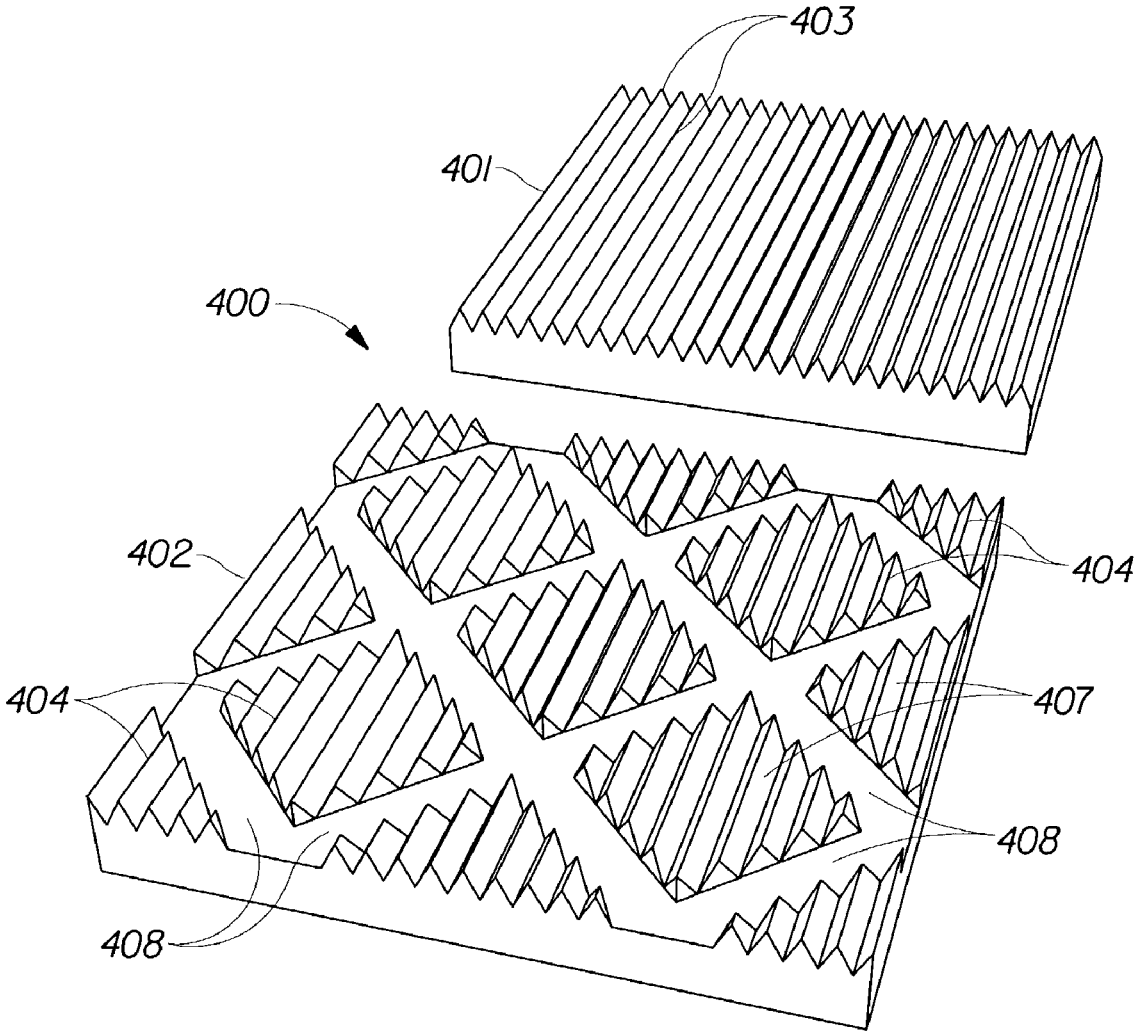
FIG. 8 is a perspective view of an apparatus used to form the textile material of the present invention with a portion of the apparatus being tilted to expose the teeth.
Figure 9:
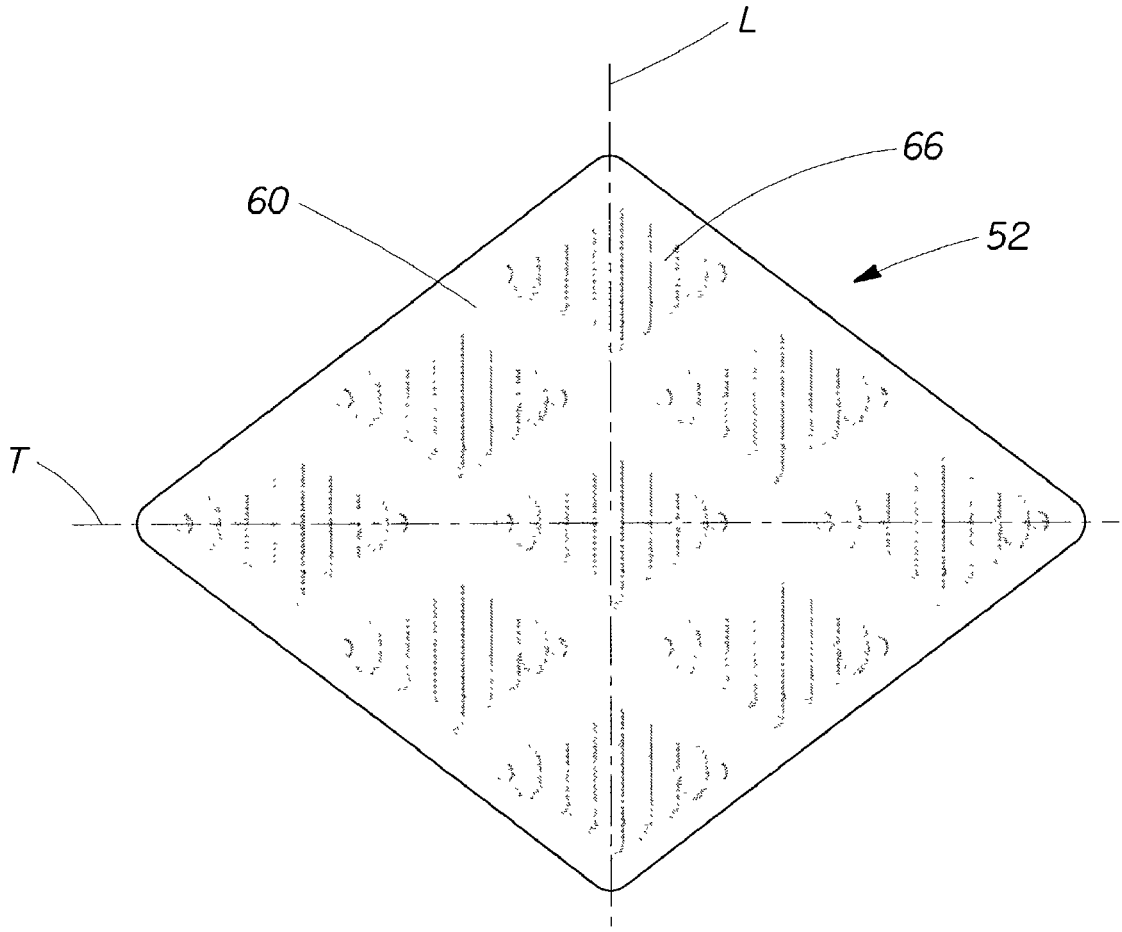
FIG. 9 is an illustration of a textured textile material of the present invention.

There are several known methods of providing incremental stretching. One method for forming textile materials of the present invention uses a means of mating plates or rolls. Referring to FIG. 8, there is shown an apparatus 400 used to form the textile material 52 shown in FIG. 9. Apparatus 400 includes the intermeshing plates 401, 402. Plates 401, 402 include a plurality of intermeshing teeth 403,404, respectively. Plates 401, 402 are brought together under pressure in a non-interfering, intermeshing manner to form the textile material of the present invention. That is, teeth 403 and 404 are caused to intermesh but preferably do not contact each other during the forming process.

Plate 402 includes toothed regions 407 and grooved regions 408. Within toothed regions 407 of plate 402 there are a plurality of teeth 404. Plate 401 includes teeth 403 that mesh with teeth 404 of plate 402. When a textile material is formed between plates 401, 402, the portions of the textile material which are positioned within grooved regions 408 of plate 402 and teeth 403 on plate 401 remain unstrained. These regions correspond to the regions 60 of textile material 52 shown in FIG. 9. The portions of the textile material positioned between toothed regions 407 of plate 402 (which comprise teeth 404) and teeth 403 of plate 401 are incrementally strained. Toothed regions 407 of FIG. 8 correspond to the incrementally strained regions 66 of the textile material 52 shown in FIG. 9. The amount of incremental straining in these portions of the textile material is controlled by the degree of intermeshing between the teeth 403 on plate 401 and 404 on plate 402. Such incremental straining creates the desired texturing of the textile material.

Figure 10:
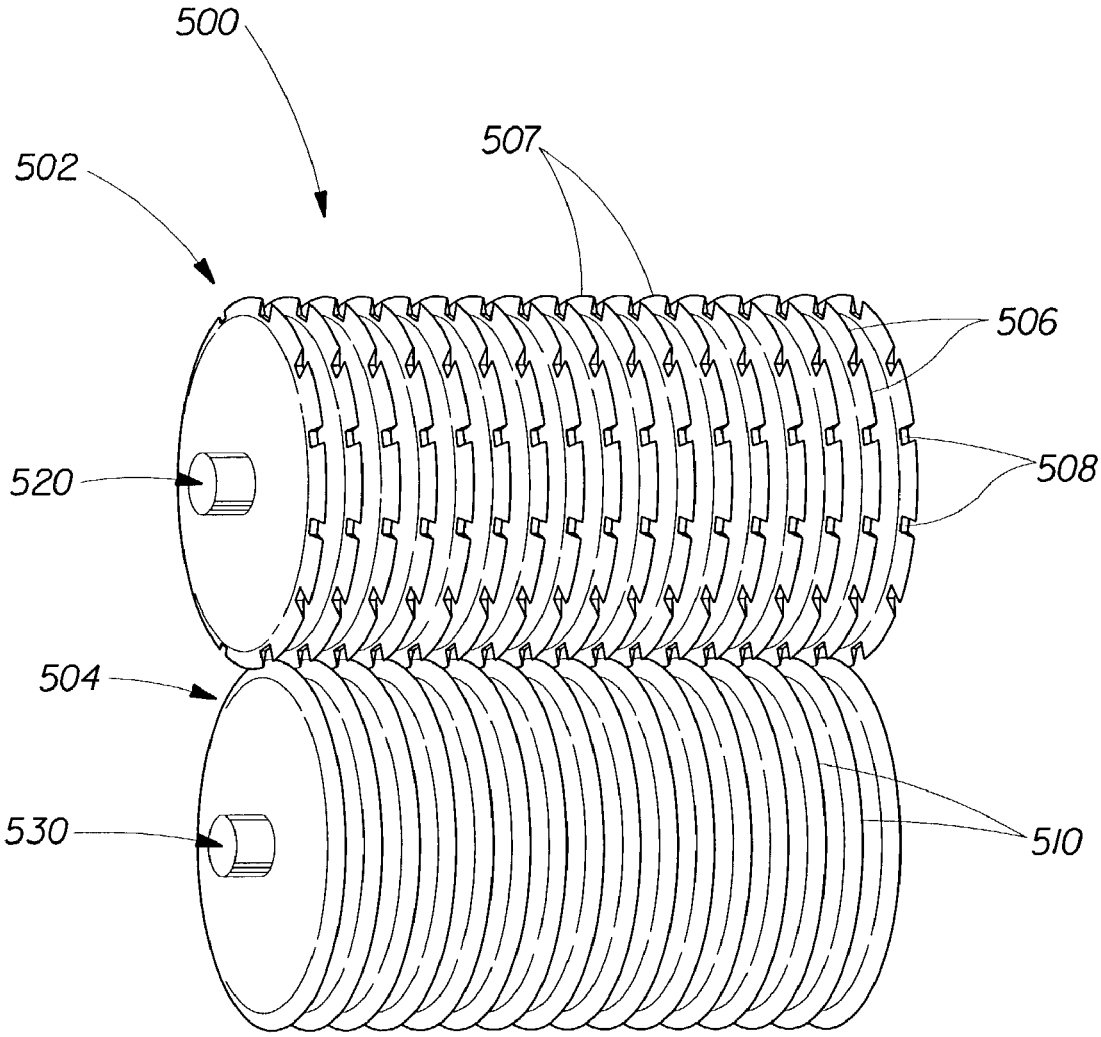
FIG. 10 is an illustration of an apparatus used to form the texturized textile material of the present invention.

In FIG. 10 there is shown a preferred means comprising an apparatus generally indicated as 500 for forming the base textile material into a formed textile material of the present invention. Apparatus 500 includes a pair of rolls 502, 504. Roll 502 includes a plurality of toothed regions 506 and a plurality of grooved regions 508 that extend substantially parallel to a longitudinal axis running through the center of the cylindrical roll 502. Toothed regions 506 include a plurality of teeth 507. Roll 504 includes a plurality of teeth 510 which mesh with teeth 507 on roll 502. As a base textile material is passed between intermeshing rolls 502 and 504, the grooved regions 508 will leave portions of the textile material unformed. The portions of the textile material passing between toothed regions 506 and teeth 510 will be incrementally strained by teeth 507 and 510, respectively.

Referring now to FIG. 1, there is shown an alternative apparatus generally indicated as 550 for forming the base textile material into a formed textile material in accordance with the teachings of the present invention. Apparatus 550 includes a pair of rolls 552, 554. Rolls 552 and 554 each have a plurality of toothed regions 556 and grooved regions 558 extending about the circumference of rolls 552, 554 respectively. As the base textile passes between rolls 552 and 554, the grooved regions 558 will leave portions of the textile material unformed, while the portions of the textile material passing between toothed regions 556 will be incrementally strained, in this case in the machine or warp direction. The amount of incremental straining in these portions of the formed textile material is controlled by the degree of intermeshing between the teeth 507 on roll 502 and teeth 510 on roll 504. As would be obvious to one skilled in the art, the degree of intermeshing can be accurately controlled by fixing the distance between roll centers, 520 and 530, such that the desired degree of incremental stretching is achieved.

EXAMPLES

FIG. 1 is a close up image of a specified region of the textile material that has been subjected to a sufficient strain to induce yarn tearing. A 0.060 inch pitch diamond pattern shown in FIG. 8 was introduced into the material at 0.065 inch depth of engagement. The material is a plain weave of 100% polyester in both warp and fill with 55 ends and 44 picks per inch. As shown, the fill yarns (running from left to right in the photograph) are torn while the warp yarns (running up and down in the photograph) remain intact but are displaced and bunched. Outside of the specified region, the weave spacing remains unaltered.

Figure 2A:
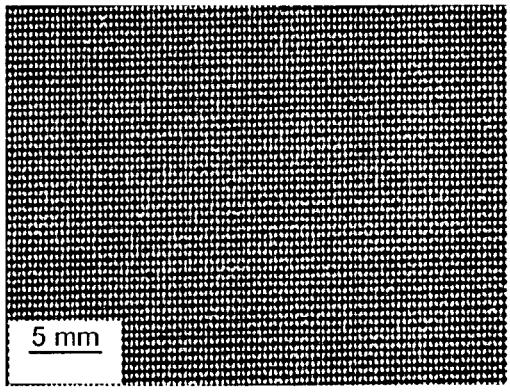
FIG. 2*a* shows the material before processing and FIGS. 2*b* and 2*c* show the material after processing.
Figure 2B:
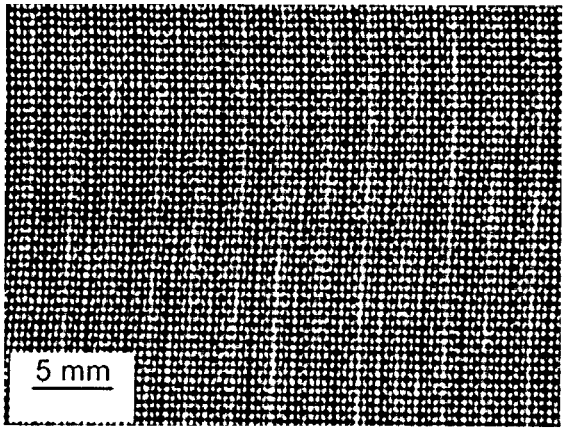
Figure 2C:
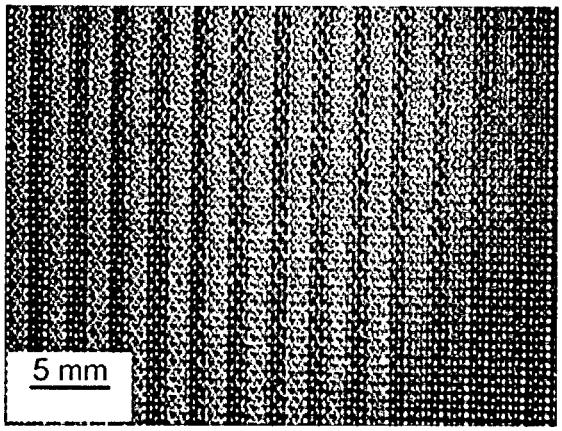

FIG. 2 is an image of the same base material as in FIG. 1. FIG. 2*a* shows the base textile material before processing. FIGS. 2*b* and 2*c* show the material after texturing at processing conditions of 0.050 inch depth of engagement and 0.100 inches pitch between rows. As shown in FIGS. 2*b* and 2*c*, the fill yarns (running from left to right in the photograph are elongated while the warp yarns (running up and down in the photograph) are redistributed as shown by the open areas where weave spacing has been altered. FIGS. 2*a* and 2*b* are optic images taken with back light alone. Removal of reflective light eliminates the visual affects caused by shadowing and emphasizes the weave pattern. FIG. 2*b* was taken with the fabric under a tension to temporarily remove three-dimensional effects. FIG. 2*c* is shown with reflective and back lighting. The shadowing illustrates the three dimensional texture. The specified region is the region isolated between a peak and valley.

Figure 3:
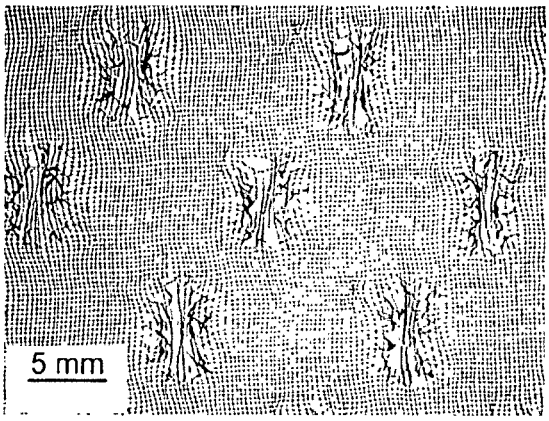
FIG. 3 is an optical microscope image of a specified region of a textile material that has been processed.

FIG. 3 is an optical microscope image of a 100% polyester plain weave fabric with 85 ends and 80 picks per inch. The fabric has been subjected to processing with a 0.060 inch pitch diamond pattern shown in FIG. 8 at 0.055 inch depth of engagement. As shown, the fill yarns are torn and the warp yarns are bunched and redistributed from their original positions within the selectively strained areas.

Figure 4:
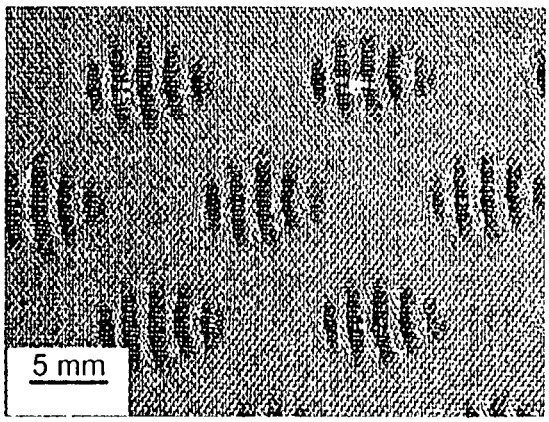
FIG. 4 is an optical microscope image of a specified region of a textile material that has been subjected to incremental strain sufficient to cause yarn tearing.

FIG. 4 is an optical microscope image of a 100% nylon fabric with 92 ends and 72 picks. It was subjected to the 0.060 inch pitch diamond pattern only at a depth of engagement of 0.075 inches. Close examination of this figure uncovers irregularities or bright spots within the strained areas. These irregularities occur where yarns have torn. Also note that the diamond shape varies greatly from the shape seen in FIG. 3 even though both were processed with the same equipment. This variation in shape is accounted for by the low coefficient of friction found on nylon, silk, and similar fabrics. The smoothness of the each yarn's surface allows the yarns to slide over each other creating a flowing texture effect.

Figure 5:
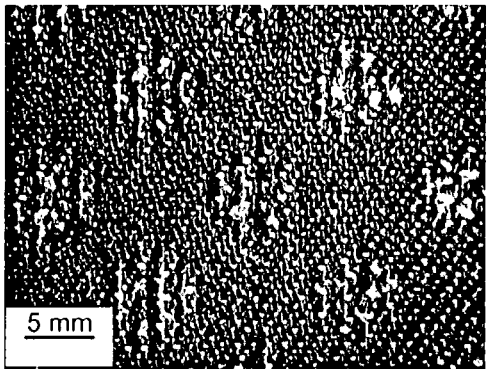
FIG. 5 is an optical microscope image of a specified region of a textile material showing a color variation at the surface of the material.

FIG. 5 is an optical microscope image of a 100% cotton twill weave fabric. The fabric has different colored yarns in the warp and fill direction. When subjected to 0.060 inch diamond pattern post processing at 0.055 inch depth of engagement, the blue warp yarns are redistributed and expose more of the white fill yarns in the areas of applied strain. Exposure of more fill yarns creates a color variation on the surface of the fabric. When the fill yarns are torn, this color variation is more intense.

Figure 6:
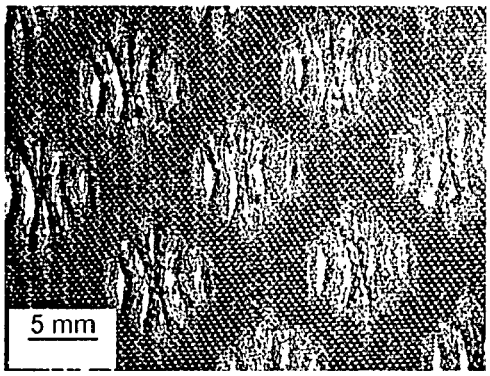
FIG. 6 is an optical microscope image of a specified region of a textile material that has been processed.

FIG. 6 is an optical microscope image of a 100% polyester plain weave fabric with 92 ends and 80 picks per inch. The fabric has been subjected to processing with a 0.060 inch pitch diamond pattern at 0.055 inch depth of engagement. Notice how the fill yarns are missing between tooth engagement points within the selectively strained area. These holes in the fabric are areas where the fill yarns have torn and the warp yarns have been redistributed away from the tooth penetration areas. The warp yarns all appear to be whole and simply bunched and moved from their original position within the weave.

Figure 7:
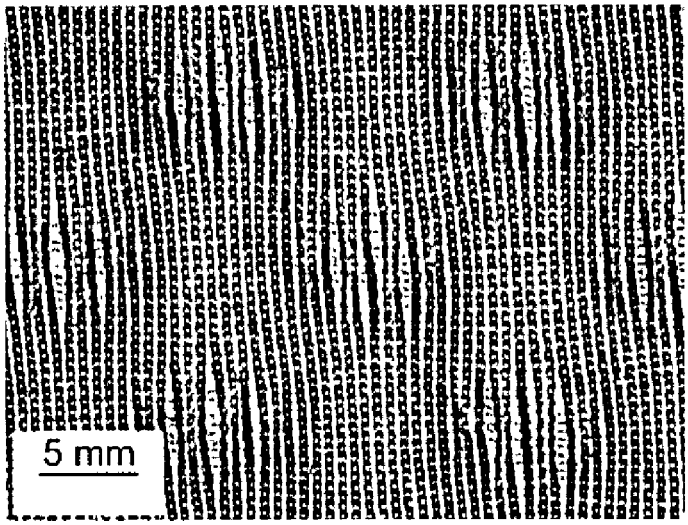
FIG. 7 is an optical microscope image of a specified region of a textile material that has been processed.

FIG. 7 is an optical microscope image taken with back light alone. The material shown is a 100% polyester knit fabric. This knit has 84 wales per inch and has been subjected to 0.060 inch pitch diamond pattern post processing at 0.075 inch depth of engagement. This back-lit image clearly shows that yarns have been redistributed in the machine direction at each point that a tooth engaged the fabric. The wales in the fill direction may have stretched or the knit structure is loose enough to accommodate the incremental strains preventing tearing. The texture shown is durable as it has been subjected to multiple wash/dry cycles and in general maintained the diamond pattern shown in this image.

What is claimed is:

1. A textile material selected from the group consisting of wovens, knit fabrics, and combinations thereof, said textile material having a MD direction and a CD direction, said textile material comprising yarns wherein the material is textured by subjecting specified regions of the material to incremental strains sufficient to cause yarn failures in yarns running in the CD direction within the specified regions, wherein yarns in the MD direction within the specified regions have substantially unaltered physical properties.

2. The textile material of claim 1 wherein the yarns in the MD direction are redistributed within the specified regions.

3. The textile material of claim 1 wherein the yarn failures are in a fill direction.

4. The textile material of claim 3 wherein the yarns in a warp direction have substantially unaltered physical properties and are redistributed within the specified regions.

5. The textile material of claim 4 wherein the yarns in the warp and fill directions are different colors.

6. A textile material selected from the group consisting of wovens, knit fabrics, and combinations thereof, said textile material having a MD direction and a CD direction, said textile material comprising yarns wherein the material is textured by subjecting specified regions of the material to incremental strains sufficient to cause permanent elongation of yarns running in the CD direction within the specified regions, wherein yarns in the MD direction within the specified regions have substantially unaltered physical properties.

7. The textile material of claim 6 wherein the yarns in the MD direction are redistributed within the specified regions.

8. The textile material of claim 6 wherein the elongated yarns are in a fill direction.

9. The textile material of claim 8 wherein the yarns in a warp direction have substantially unaltered physical properties and are redistributed within the specified regions.

10. The textile material of claim 9 wherein the yarns in the warp and fill directions are different colors.

11. A method of manufacturing a woven or knit fabric containing yarns comprising the step of subjecting specified regions of the material to incremental strains sufficient to cause failure or permanent elongation of yarns running in a CD direction within the specified region wherein yarns running in a direction orthogonal to the failed or permanently elongated yarns within the specified regions have substantially unaltered physical properties.

12. A method of manufacturing a woven or knit fabric containing yarns comprising the step of subjecting specified regions of the material to incremental strains sufficient to cause failure or permanent elongation of yarns in a CD direction and redistribution of yarns running in a direction orthogonal to the failed or permanently elongated yarns.

* * * * *

UNITED STATES PATENT AND TRADEMARK OFFICE

CERTIFICATE OF CORRECTION

PATENT NO. : 7,183,231 B2
APPLICATION NO. : 10/289770
DATED : February 27, 2007
INVENTOR(S) : Hoying et al.

It is certified that error appears in the above-identified patent and that said Letters Patent is hereby corrected as shown below:

Column 6

Figure 11:
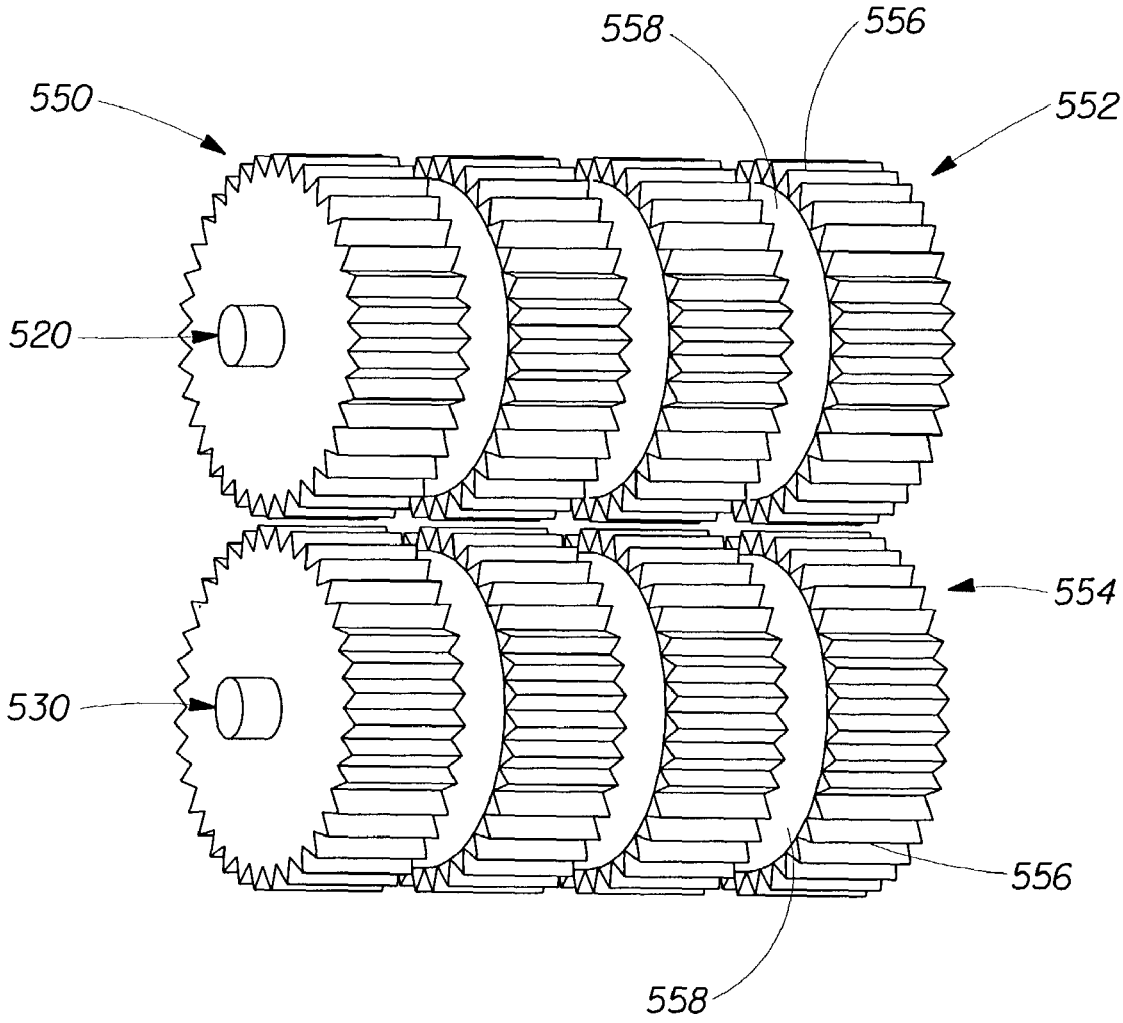
FIG. 11 is another illustration of an apparatus used to form the texturized textile material of the present invention.

Line 26, delete "FIG. 1" and insert --FIG. 11--.

Signed and Sealed this

Twenty-sixth Day of June, 2007

JON W. DUDAS
*Director of the United States Patent and Trademark Office*